United States Patent [19]

Hensey

[11] 4,281,787

[45] Aug. 4, 1981

[54] CONTAINER AND BLANK FOR CONSTRUCTING SAME

[75] Inventor: Warren R. Hensey, Highland, Mich.

[73] Assignee: Ex-Cell-O Corporation, Troy, Mich.

[21] Appl. No.: 86,120

[22] Filed: Oct. 17, 1979

[51] Int. Cl.[3] ..... B65D 5/74

[52] U.S. Cl. ..... 229/17 G; 229/DIG. 4; 493/183; 493/160; 493/452

[58] Field of Search ..... 229/17 R, 17 G, 37 R; 93/36.8

[56] References Cited

U.S. PATENT DOCUMENTS

| | | | |
|---|---|---|---|
| 3,116,002 | 12/1963 | Crawford et al. | 229/17 G |
| 3,120,355 | 2/1964 | Gleston et al. | 229/17 G X |
| 3,291,369 | 12/1966 | Crawford | 229/17 G X |
| 3,675,015 | 7/1972 | Geib | 229/17 G X |
| 3,869,078 | 3/1975 | Braun | 229/17 R |
| 3,892,347 | 7/1975 | Egleston | 229/17 R |
| 4,012,997 | 3/1977 | Bachmer et al. | 93/36.8 |
| 4,078,751 | 3/1978 | Larsson et al. | 229/17 R |
| 4,093,115 | 6/1978 | Bachner et al. | 229/17 G |
| 4,184,624 | 1/1980 | Magill | 229/17 G |
| 4,206,867 | 6/1980 | Skjelky | 229/17 G |
| 4,211,357 | 7/1980 | Lisiecki | 229/17 G |

*Primary Examiner*—Davis T. Moorhead
*Attorney, Agent, or Firm*—John P. Moran

[57] ABSTRACT

A coated paperboard container and a blank for constructing same are disclosed as including a body portion having a side seam flap secured adjacent the edge portion of one of four side panels and an upper end that is closed by a folded top end closure which includes closure panels having a construction that enhances foldability and sealing. Front and back triangular gable panels of the top end closure are each flanked by a pair of triangular fold-back panels that have different sizes than each other so as to facilitate folding of the sealed top end closure from a vertical position in a direction toward the smaller of the fold-back panels. The lower score line portions adjacent the smaller inner roof panel are formed wider than the other score lines so as to further enhance the folding of the top sealed panels in the direction of the gable side bearing the side seam flap upper extension.

3 Claims, 10 Drawing Figures

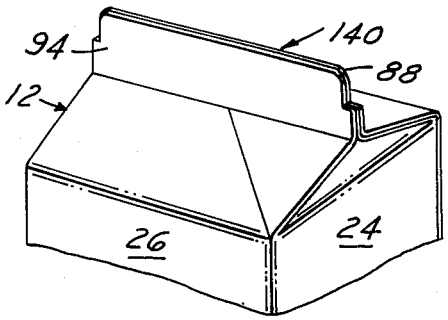
FIG.5
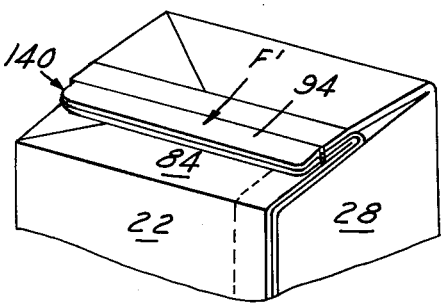
FIG. 7
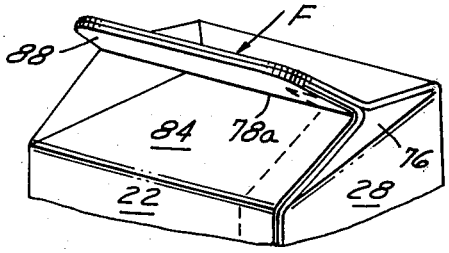
FIG.6
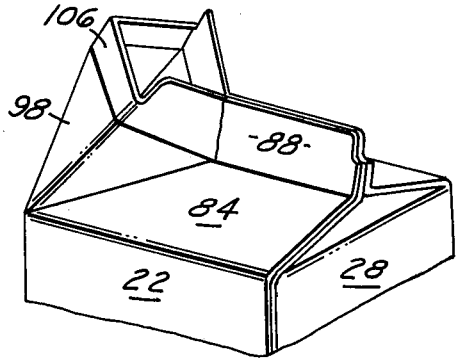
FIG.8
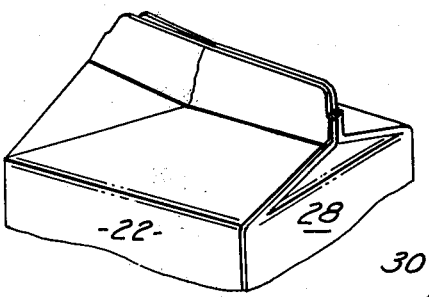
FIG.9
FIG.10
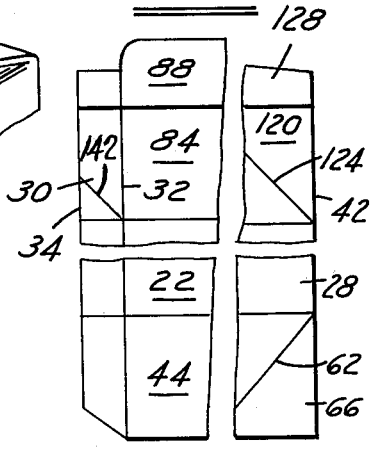

CONTAINER AND BLANK FOR CONSTRUCTING SAME

TECHNICAL FIELD

The invention relates generally to a thermoplastic coated paperboard container and, more particularly, to a blank for constructing the container so as to include a body portion having a top end closed by a folded end closure of an improved construction.

BACKGROUND ART

Containers for beverages such as milk, cream, other dairy products, juices, and the like are conventionally constructed from thermoplastic coated paperboard. One type of these containers includes a top end closure with a folded gable roof having a vertically projecting seal at the roof rigde for sealing the container and providing a pouring spout when the contents of the container are to be dispensed. Stacking of such containers requires the use of separating trays intermediate different layers due to the vertically projecting seals of their top end closures. Also, storage space is lost in stacking these containers due to the empty space resulting from the configuration of the top end closure. Such containers are shown by U.S. Pat. Nos. 3,116,002 and 3,120,335. Another type of container includes flat top end closures that are folded and have a flat seal projecting from a centerline of the closure with an outer end that is releasably secured to the rest of the closure generally adjacent one of its sides. Various releasable securements are provided for releasing the flat seals to permit them to be opened and to thereby provide access to a pouring spout for dispensing the beverages. U.S. Pat. Nos. 3,869,078 and 3,892,347 disclose such flat top end closures. A further type of container is disclosed by U.S. Pat. No. 4,078,715 and includes a top end closure with an inclined seal that includes a "harder crease" on one side of the seal for facilitating folding of the seal from a vertical position to the inclined position.

U.S. Pat. Nos. 4,012,997 and 4,093,115 disclose a container folding method and the container made by the method wherein certain roof panels of the top end closure are provided with double score lines extending alongside each other. Folding of a top seal of the end closure from a vertical position to a flat position requires the application of a downward force along the lower double score line on one side of the top seal and the application of another force to bend the top seal downwardly. Each additional application of force for folding the top end closure requires an additional folding tool on the folding mechanism.

Coated paperboard blanks for constructing each type of container described above are made on converting machines like those disclosed by U.S. Pat. Nos. 2,682,208 and 3,731,600. After construction of the blanks to form the containers, application of heat or high frequency vibration, applied by clamping pressure to inter-engaged portions of the blanks, provides sealing of the containers.

Front portions of the outer seal lips and the front inner seal lip cooperate with the front gable panel and the inner roof panels connected thereto to define the pouring spout used to dispense the contents of the container.

DISCLOSURE OF THE INVENTION

An object of the present invention is to provide an improved coated paperboard container and a blank for constructing the container including a leak-proof top end closure comprised of a folded roof and a top seal for sealing the roof, and wherein the score line construction of the top end closure enhances foldability of the top seal from a vertical attitude to a slanted or horizontal attitude.

Another object of the invention is to provide such a blank from which a liquid carrying slant top or flat top container is constructed, wherein the resultant top seal is folded toward the side of the roof which includes the extra thickness of the usual side seam flap, causing the double thick panels to be folded onto themselves into a four layer thick configuration, rather than being folded toward the opposite side, such that the double thick roof panel is straightened out. Thus, at the juncture of the side seam panel and the roof and top seal panels, the sealed edge portions are urged into a compression mode during the folding over process, rather than into tension, thereby effectively eliminating leakage by eliminating the possibility of a channel being created by fiber separation during application of the tension force.

A further object of the invention is to provide a container in accordance with the present invention which includes a score line formed a predetermined amount wider than the other score lines, connecting one of the outer seal panels and the associated outer roof panel at a lower elevation than the apices of the front and back gable panels, and each score line between the inner seal lips and the associated pair of fold-back panels thereof is formed as a wider score line so as to intersect the respective front and back gable panels at points below the apices thereof. The fold-back panels on one side of the top seal of the constructed end closure are thus of a smaller size than the fold-back panels on the other side of the top seal. Sealing of the top seal is performed with the inner and outer seal lips located in a generally vertical position. Each of the score line portions between the smaller triangular fold-back panels and their associated inner seal lips, and the lowered score line between the one outer seal lip and its associated outer roof panel, being wider than the other score lines of the top end closure, facilitates folding of the top seal from the vertical position to either an inclined position for providing a slant top, or a horizontal position where the top seal is adhesively bonded to the adjacent outer roof panel to provide a flat top end closure. Such wider score line arrangement thus compensates for any increased effort required for folding the top seal in the direction of the side of the roof having the extra thickness of the side seam or fifth panel.

Other objects and advantages of the invention will become more apparent when reference is made to the following description and accompanying drawings.

BRIEF DESCRIPTION OF DRAWINGS

FIG. 5 is a fragmentary perspective view showing the container of FIG. 4 with the sealing panels in a vertical position to accommodate sealing of the container top end closure structure;

FIG. 6 is a fragmentary perspective view showing the container turned around after the top seal has been bent from the vertical position of FIG. 5 to the inclined position shown in order to provide a slant top container;

FIG. 7 is a fragmentary perspective view showing the container illustrated in FIGS. 5 and 6 after the hold-down portion has been sealed to the outer surface of the inner roof panel to provide a flat top container;

FIG. 8 is a fragmentary perspective view showing the container of FIG. 7, after the seal of FIG. 7 is broken, and with the container in its open position to form a pouring spout;

FIG. 9 is a fragmentary perspective view showing the container of FIG. 9 after the pouring spout has been moved to the closed position to reclose the container; and FIG. 10 is a fragmentary layout view of an alternate embodiment of the invention.

BEST MODE OF CARRYING OUT THE INVENTION

Figure 1:
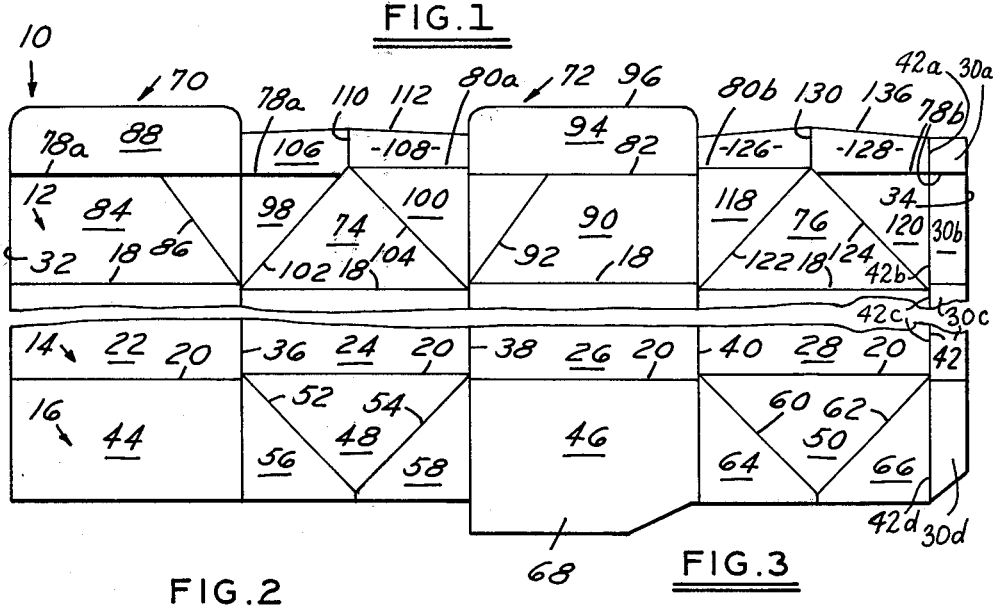
FIG. 1 is a broken layout view of the inside surface of a coated paperboard container blank used to construct a container having a top end closure with a roof and a top seal arrangement in accordance with the present invention.

Referring now to the drawings in greater detail, FIG. 1 illustrates a container blank 10 formed in accordance with the principles of the present invention. The container blank 10 is generally divided into three sections including a top end closure 12, a body portion 14, and a flat bottom end closure 16. A staggered lower top horizontal score line 18 extends transversely across the container blank 10 and separates the top end closure 12 and the body portion 14. A bottom staggered horizontal score line 20 extends transversely across the container blank 10 and separates the bottom end closure 16 and the body portion 14. The body portion 14 comprises a plurality of integrally connected body panels, namely, a side panel 22, a front panel 24, a side panel 26 and a back panel 28, and a side seam flap or narrow fifth panel 30 formed adjacent the back panel 28. The container blank 10 is defined on its longitudinal sides by its edges 32 and 34. The body panels 22, 24, 26 and 28, and the side seam flap 30, are defined by vertical score lines 36, 38, 40 and 42.

The flat bottom end closure 16 has a pair of external closure panels 44 and 46 which are integral with and extend longitudinally from the body panels 22 and 26, respectively. A pair of triangular closure panels 48 and 50 are an integral part of the flat bottom end closure 16, and they extend longitudinally from the body panels 24 and 28, respectively. The triangular closure panel 48 is defined by the transverse score line 20 and bottom diagonal score lines 52 and 54. The triangular closure panel 48 is integrally connected to the external closure panels 44 and 46 by a pair of integral fold back panels 56 and 58, respectively. The triangular closure panel 50 is defined by the horizontal score line 20 and a pair of bottom diagonal score lines 60 and 62. A pair of integral fold back panels 64 and 66 integrally connect the triangular closure panel 50 to the external closure panel 46 and the side seam flap 30, respectively. As is set forth in more detail hereinafter, the side seam flap 30 is connected to the external full closure panel 44 so as to place the fold back panel 66 adjacent the external closure panel 44 is a constructed or erected container. As shown in FIG. 1, the external closure panel 44 is not provided with any extended tuck-in flap, but the external closure panel 46 is provided with an integral overlap flap 68. The details of the bottom end closure 16, with a tuck-in flap, are discussed in detail in U.S. Pat. No. 3,498,524 and U.S. Pat. No. 3,120,335, and these patents are incorporated herein by reference.

The flat top end closure 12 comprises roof panels 70 and 72. The panels 70 and 72 are connected integrally to the upper ends of the body panel members 22 and 26, respectively. A triangular gable or spout panel 74 and a triangular gable or closure panel 76 are connected integrally to the body panels 24 and 28, respectively. A staggered upper top horizontal score line, consisting of portions 78*a* and *b*, 80*a* and *b* and 82, extends transversely from the blank edge 32 to the blank edge 34, substantially parallel to the horizontal score lines 18 and 20. As will be explained in greater detail later, the score line portions 78*a* and *b* are wider than the other score line portions.

The roof panel 70 is divided basically into two portions by the horizontal score line 78*a*. A lower closure panel 84 is defined by the edge 32 and the score lines 36, 78*a* and 18. An opening assist score line 86 extends substantially from the intersection of the score line 18 and the score line 36 to a point on the score line 78*a* that is closer to the score line 36 than to the edge 32. An upper closure panel portion 88 of the outer roof panel 70 serves as a sealing panel, as will be explained.

The roof panel 72 is divided into two parts by the score line 82. The inner part of the roof panel 72 comprises a lower closure panel 90 which is defined by the horizontal score lines 82 and 18 and the vertical score lines 38 and 40. An opening assist score line 92 extends from the intersection of score lines 18 and 38 to a point on the score line 82. The last mentioned intersection on the score line 82 is closer to the score line 38 than to the score line 40, and it is substantially the same distance from the score line 38 as the opening assist score line 86 is from the score line 36 along the score line 78*a*. The roof panel 72 includes an upper closure panel 94 which is integral with the closure panel 90, and it is separated therefrom by the score line 82. The upper outer edge 96 of the closure panel 94 is perpendicular to extensions of the vertical score lines 38 and 40.

The triangular spout panel 74 is connected to a pair of inner roof or fold-back panels 98 and 100 by diagonal score lines 102 and 104, respectively. The fold-back panels 98 and 100 connect the triangular spout panel 74 to the closure panels 84 and 90, respectively. A pair of pouring panels or infold lips 106 and 108 are integrally connected to the fold-back panels 98 and 100, respectively, and they are defined by a portion of the horizontal score line 78*a* and the score line 80*a*, respectively, the vertical score lines 36 and 38, and a vertical gable score line 110. As shown in FIG. 1, the upper outer edge 112 of the triangular spout panel 74 may be straight or formed as an inverted V-shaped edge (FIG. 1). The triangular base angles of the spout panel 74 are normally formed so as to be equal.

The triangular closure panel 76 is integrally connected to a pair of inner roof or fold-back panels 118 and 120 by diagonal score lines 122 and 124, respectively. The fold-back panel 118 integrally connects the triangular closure panel 76 to the closure panel 90. A pair of closure panels or infold lips 126 and 128 are connected to the fold-back panels 118 and 120, respectively, and they are defined at their lower ends by the score lines 80*b* and 78*b*, respectively, and at their outer edges by the score lines 40 and 42, respectively. The closure panels 126 and 128 are separated from each other by a vertical gable score 130. The triangular base angles of the closure panel 76 are normally formed so as to be equal. The upper outer edge 136 of the closure panel 76 may be straight or formed as an inverted V-shaped edge.

As illustrated in FIG. 1, the score line portion 78*a*, extending between the edge 32 and the diagonal score line 102 offset from the vertical score line 110, and the portion 78*b* extending between the diagonal score line 124 and the edge 34 are wide, straight score lines, dropped a predetermined distance from the adjacent score lines 80*a* and 80*b*, respectively, and aligned with the intermediate score line portion 82. As such, the adjacent triangular fold-back panels 98 and 120 are smaller than the respective inner roof panels 100 and 118. This difference in size, in conjunction with the weakening effect caused by the widened score lines 78*a* and 78*b*, enhances the foldability of the top end closure, as will be explained.

Figure 2:
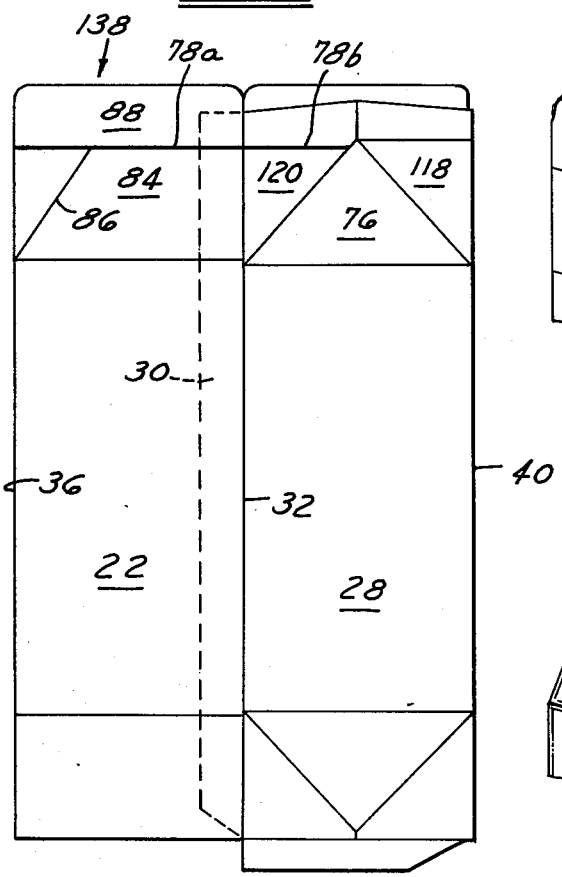
FIG. 2 is a layout view of the outside surface of a container structure after it is side seamed from the container blank illustrated in FIG. 1.

The container black 10 illustrated in FIG. 1 is formed into a side seam blank as illustrated in FIG. 2, and as designated by the numeral 138. The side seam blank 138 is formed by rotating the body panel 28 and the side seam flap 30 as a unit about the vertical score line 40, and having the inside surfaces of the body panel 28 come into contact with the inside surface of the body panel 26, with the vertical score line 42 positioned next to the vertical score line 38, and with the inside surface of the side seam flap 30 contacting the inside surface of the body panel 24 adjacent the vertical score line 38. The body panel 22 is then rotated about the vertical score line 36 to bring its inside surface into contact with the inside surface of the body panel 24. The inside surface of the body panel 22 along the edge 32 comes into contact with the outside surface of the side seam flap 30, and the edge 32 is positioned parallel and aligned with the vertical score line 42. The various members of the flat top end closure 14 and the bottom end closure 16 will make similar movements, and the container will appear as illustrated in FIG. 2. The container blank 10 is then sealed where the inside area of the body panel 22 comes into contact with the outside surface of the side seam flap 30.

Figure 3:
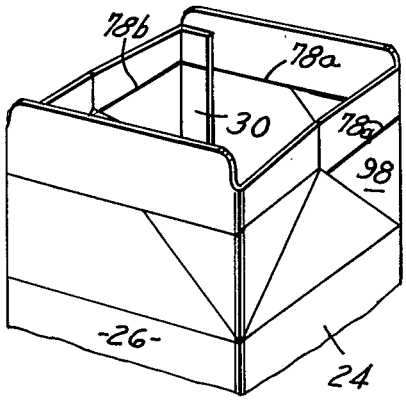
FIG. 3 is a fragmentary perspective view showing the side seamed container blank illustrated in FIG. 2 in an open ended top end view prior to the closing of the top closure structure of the present invention.

The next step in forming the side seam blank 138 into a container is illustrated in FIG. 3. FIG. 3 illustrates how the side seam blank 138 is opened up into a squared condition, after which the flat bottom end closure 16 is formed in a manner well known in the container art, and disclosed in detail in the above cited prior art patents. However, generally, in the forming of the flat bottom end closure 16, the triangular closure panels 48 and 50 are moved about the horizontal score line 20 toward the middle of the container. The fold back panels 56/58 and 64/66 rotate about the diagonal score lines 52/54 and 60/62, respectively, with their outside surfaces contacting the outside surfaces of the respective triangular closure panels 48 and 50. At the same time, the external closure panels 44 and 46 are moving towards each other, with the overlap flap 68 overlapping a portion of the closure panel 44. The various portions of the flat bottom end closure 16 are then sealed, either by heat or high frequency vibration techniques, to form a liquid tight flat bottom end closure structure.

After the bottom end closure 16 is formed and a product, such as milk or juice, has been inserted in the container, the various parts of the top end closure 12 are folded about the various score lines in the following manner so as toform the top end structure 12. The triangular spout panel 74 is moved around the horizontal score line 18 over the end of the filled container and towards its center. At the same time, the triangular closure panel 76 is moved toward the middle of the filled container about the horizontal score line 18. The outside surfaces of the pouring panels 106 and 108 will be rotated towards each other about the vertical score line 110, and the closure panels 126 an 128 will have their outside surfaces rotated towards each other about the vertical score line 130. The inside surfaces of the pouring panel 108 and the closure panel 126 will come into contact with the sealing panel 94. The inside surface of the pouring panel 106 and closure panel 128 will come into contact with the closure panel portion 88.

Figure 4:
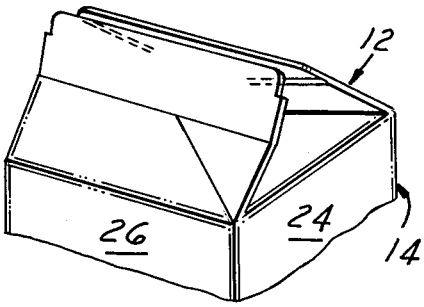
FIG. 4 is a fragmentary perspective view, similar to FIG. 3, and showing the container evolved from the blank of FIG. 3 in a partially closed condition.

As viewed in FIG. 4, the last mentioned top closure elements come to a position at an angle to the top end of the body portion 14. The sealing of the last mentioned elements of the top closure 12 is accomplished by conventional means, such as a sonic or high frequency vibration sealing means, such a seal providing a liquid tight seal, and yet being easily opened. The sealing of these various top end closure elements may also be accomplished by other means, such as gas heat, if desired.

FIG. 5 illustrates the positions of the various elements of the top end closure 12 once the sealing thereof has been effected, i.e., with the sealing panels 94 and 88 being disposed in a position perpendicular to a plane perpendicular to the side panels 22, 24, 26 and 28 to form a top seal 140. The filled container can be utilized in this manner, comparable to a conventional straight up vertical gable top, but may have a shorter gable height relative thereto.

Alternatively, the top seal 140 may be moved to an inclined position by the application of a force F, as shown in FIG. 6, wherein the container has been rotated 180°, in order to provide a, so-called, slant top container. As indicated above, folding of the top seal 140 to the slant top position shown in FIG. 6 is facilitated by the wider dropped score lines 78*a* and 78*b* and the smaller triangular fold-back panels 98 and 120. More specifically, the top seal 140 extends toward the smaller fold-back panels 98 and 120 which are partially defined by the wide score lines 78*a* and 78*b*, respectively. It should be noted that at the juncture of the side seam panel 30 and the top closure panels 84 and 88 adjacent the wide score line 78*a*, the panel portions are urged into a compression mode during the fold-back-over process, rather than into tension, thereby effectively eliminating leakage by eliminating the possibility of a channel being created by fiber separation during application of the tension force.

The versatility of the container blank 10 shown in FIG. 1 is further demonstrated by FIG. 7 wherein the top seal 140 is shown folded over a horizontal position in order to provide a flat top end closure, thereby even more effectively preventing top end leakage characteristics. The application of a force F′, by use of a suitable tool, serves to move the top seal into contact with the side of the container on which the lowered, wide score lines 78*a* and 78*b* are located. The upper closure panel 88 is then releasably secured to the outer roof panel 84 by a suitable adhesive bond provided in any conventional manner in order to provide the flat top closure.

Opening of the constructed flat top end closure is effectuated by first releasing the top seal 140 from the outer roof panel 84, and then moving the top seal to either the slant position of FIG. 6 or the vertical position of FIG. 5 followed by opening of the pouring spout in the well known manner, to the position shown in FIG. 8. The front gable panel 74 and its connected inner roof panels 98 and 100 cooperate with the spout portions of the outer roof panels 84 and 90 to provide the pouring spout that is used to dispense the contents of the container. The container may then be reclosed after which the top seal 140 will assume an attitude similar to that shown in FIG. 9.

The upper closure panels 88 and 94, which are secured to each other as shown in FIG. 5 by the above mentioned application of either high frequency vibration or heat techniques, may be prevented from forming a complete seal with the inner seal lip associated with the front triangular gable panel 74 by applying an abhesive material in the well known manner to the infold lips 106 and 108 and adjacent portions of panels 98 and 100, and to the closure panels 88 and 94, respectively. This abhesive coating may be made of any suitable material, such as a silicone based material, that prevents sealing between different portions of the container and permits the sealed top end closure to be more easily opened from its closed conditions of FIGS. 7, 6 or 5 to its open condition of FIG. 8 where the pouring spout is provided.

Referring now to FIG. 10, there is shown an alternate embodiment to the container blank 10 of FIG. 1. In this arrangement, the side seam flap or fifth panel 30 is formed adjacent the side panel 22, rather than adjacent the back panel 28, and includes an additional diagonal score line 142 for cooperation with the diagonal score line 124 during erection of the container. As illustrated, 32 is a score line between the panels 30 and 22, and 42 is a raw edge of the blank. Also, in both the FIG. 1 and FIG. 10 structures, if desired, in the formation of the side seam blank 138 the side seam panel 30 could be sealed to the outside surface of the adjacent side panel 22 or back panel 28, respectively, rather than to the inner surface thereof as described above relative to FIG. 2.

INDUSTRIAL APPLICABILITY

It should be apparent that slant top containers like the container shown in FIG. 6 can be packed in layers on top of each other to minimize the storage and cargo space necessary by virtue of their slant top seals being deflected downwardly. Unlike folded gable roof closures with vertically projecting seals (FIG. 5), this container does not require any shipping tray intermediate the different layers of stacked containers. These advantages are also apparent with respect to flat top end closures, as shown in FIG. 7.

It should be further apparent that the construction embodying the wider, lower score line on one side of the top end closure ehhances the foldability of the top seal toward the smaller inner roof panels into either a slant top or a flat top container.

While but two embodiments of the invention have been shown and described, other modifications thereof are possible.

What is claimed is:

1. In a thermoplastic coated paperboard container adaptable to being folded into leakproof "slant top" or "flat top" container from a gable top configuration, and including a tubular body formed from a blank having four side panels and a side seam panel formed on one end thereof intermediate first and second vertical cut edges, and having a bottom closure thereon, a pair of opposed roof panels overlying said body, a pair of opposed triangular end panels in-folded between said roof panels from the opposite ends thereof, two pairs of triangular fold-back panels, each pair of which is integral with a respective one of said infolded triangular end panels along fold lines which underlie said roof panels, said fold-back panels being folded adjacent the undersides of said roof panels, an upper closure panel surmounting each of said roof panels, two pairs of infold lips joined by fold lines and surmounting respective pairs of triangular fold-back panels and adjoining triangular end panels, an extensible pouring spout housed in collapsed condition within said container and defined in part by one of said triangular end panels and an adjacent pair of said fold-back panels, said spout also being defined by adjacent portions of said roof panels and upper closure panels, said side seam panel being secured along the edge portion of the side panel and roof panel and upper closure panel located at the opposite end of said blank, the improvement characterized by having a first wide score line portion formed between said one roof panel and the adjacent upper closure panel and extending laterally from said first vertical cut edge, a second wide score line portion formed across each of the fold-back panels and adjacent infold lips positioned adjacent opposite ends of said one roof panel and the adjacent upper closure panel, and a third wide score line portion extending laterally from said second vertical cut edge and formed across said side seam panel to communicate with one of said second wide score line portions to enhance the folding of said upper closure panels in the direction of the first, second and third wide score line portions, to thereby place the juncture of the side seam panel and adjacent roof panel and upper closure panel in the vicinity of the adjacent wide score line portions in compression and thus eliminate the possibility of leakage therebetween.

2. A container adaptable to being folded into a leakproof "slant top" or "flat top" container from a gable top configuration, the container comprising four side body panels and a side seam panel overlapping and sealed to a free edge portion of one of said four side body panels so as to form a four-sided tubular body, oppositely disposed roof panels respectively connected to two of said side body panels, upper closure panels respectively connected to said roof panels, a first wide score line formed intermediate one of said upper closure panels and the adjacent roof panel, an infold lip and a fold back panel folded behind each of the front and rear halves of said one upper closure panel and the adjacent roof panel, respectively, second wide score lines formed intermediate said last-mentioned infold lips and fold back panels, an extension formed on the upper end of said side seam panel and sealed to the inner surface of said one upper closure panel and the adjacent roof panel and, a third wide score line formed on said extension, said upper closure panels being folded around said first, second and third wide score lines, thereby urging the sealed edge portions at the juncture of said side seam panel and the roof and upper closure panels into a compression mode, and thus eliminating the possibility of a channel being created therebetween by fiber separation.

3. A blank for constructing a container adaptable to being folded into a leak-proof "slant top" or "flat top" container from a gable top configuration, the blank comprising a first side body panel, a front body panel, a second side body panel, a rear body panel, and a side seam panel serially connected between first and second vertical cut edges; bottom end closure panels connected to respective lower ends of said body and side seam panels; top end closure panels connected to respective upper ends of said body and side seam panels; said top end closure panels including front and back triangular panels respectively connected to the top ends of said front and back body panels; a pair of lower closure panels respectively connected to the top ends of said side body panels; and first and second vertically aligned extensions formed on the top end of said side seam panel; a pair of front fold back panels and a pair of rear fold back panels located on opposite sides of said front and back triangular panels; a pair of upper closure panels; a pair of front infold lips and a pair of rear infold lips; a first wide, lowered, horizontal score line extending from said first vertical cut edge intermediate said upper closure panel and said lower closure panel above said first side body panel and intermediate one of the front pair of infold lips and the adjacent fold back panel to said front triangular panel above said front body panel; a second wide, lowered, horizontal score line extending from said second vertical cut edge intermediate said first and second extensions above said side seam panel and intermediate one of the rear pair of infold lips and the adjacent fold back panel to said rear triangular panel above said rear body panel; and standard substantially horizontal score lines formed intermediate the inner ends of said first and second wide, lowered, horizontal score lines with at least the score line portions thereof between the other of each of said front and rear pairs of infold lips and the respective adjacent front and rear fold back panels being narrower and positioned higher than said wide, lowered, horizontal score lines.

* * * * *